US009934619B2

(12) United States Patent
Brands

(10) Patent No.: US 9,934,619 B2
(45) Date of Patent: Apr. 3, 2018

(54) ROAD TOLL SYSTEM AND METHOD

(75) Inventor: Jan Rene Brands, Nijmegen (NL)

(73) Assignee: Telit Automotive Solutions NV, Leuven (BE)

( * ) Notice: Subject to any disclaimer, the term of this patent is extended or adjusted under 35 U.S.C. 154(b) by 433 days.

(21) Appl. No.: 13/414,350

(22) Filed: Mar. 7, 2012

(65) Prior Publication Data

US 2012/0232964 A1 Sep. 13, 2012

(30) Foreign Application Priority Data

Mar. 11, 2011 (EP) ..... 11157818

(51) Int. Cl.
*G07B 15/00* (2011.01)
*G07B 15/06* (2011.01)
*G07C 9/00* (2006.01)

(52) U.S. Cl.
CPC ..... *G07B 15/063* (2013.01); *G07C 9/00174* (2013.01)

(58) Field of Classification Search
CPC ... G07B 15/063; G07B 15/02; G06Q 30/0284
USPC ..... 705/13, 35, 418; 340/928; 455/41.2
See application file for complete search history.

(56) References Cited

U.S. PATENT DOCUMENTS 5,422,473 A 6/1995 Kamata
5,694,322 A * 12/1997 Westerlage et al. ..... 705/417
5,767,505 A * 6/1998 Mertens et al. ..... 235/61 S
5,790,051 A * 8/1998 Yoshida et al. ..... 340/928
5,864,831 A * 1/1999 Schuessler ..... 705/417
6,141,609 A * 10/2000 Herdeg ..... G07C 5/008 340/995.1
6,323,566 B1 11/2001 Meier
(Continued)

FOREIGN PATENT DOCUMENTS

CN 1295697 A 5/2001
CN 1518725 A 8/2004
(Continued)

OTHER PUBLICATIONS

"Security Aspects of the EETS" published on Apr. 5, 2007 by Expert Group 12, pp. 1-86 (Year: 2007).*
(Continued)

*Primary Examiner* — Brian M Epstein
(74) *Attorney, Agent, or Firm* — Pearl Cohen Zedek Latzer Baratz LLP

(57) ABSTRACT

The invention relates to a road toll system using a vehicle-mounted satellite navigation receiver, from which routes taken and road prices incurred are determined. A billing system bills a user in dependence on the road prices incurred. A portable activation device transmits information concerning the owner of the portable activation device to the vehicle-mounted unit, and the vehicle-mounted unit provides information to the billing system to enable identification of the owner of the portable activation device.

In combination, the portable activation device and the vehicle-mounted unit can be considered to function in a similar way to a known vehicle-mounted OBU. However, by separating the data necessary to provide user-personalization into the portable activation device, the vehicle-mounted unit can become more standard, and the user is able to drive other vehicles more easily.

16 Claims, 3 Drawing Sheets

(56) References Cited

U.S. PATENT DOCUMENTS

| | | | | |
|---|---|---|---|---|
| 6,329,901 | B2 * | 12/2001 | Brinkmeyer et al. | 340/5.4 |
| 6,816,707 | B1 * | 11/2004 | Barker et al. | 455/41.2 |
| 6,823,258 | B2 * | 11/2004 | Ukai et al. | 705/4 |
| 7,010,688 | B1 | 3/2006 | Kawasaki | |
| 7,630,918 | B2 * | 12/2009 | Gila et al. | 705/13 |
| 7,778,746 | B2 * | 8/2010 | McLeod et al. | 701/22 |
| 7,835,753 | B2 | 11/2010 | Alfert et al. | |
| 8,140,358 | B1 * | 3/2012 | Ling et al. | 705/4 |
| 2003/0177094 | A1 * | 9/2003 | Needham et al. | 705/50 |
| 2004/0119609 | A1 * | 6/2004 | Solomon | 340/928 |
| 2005/0071202 | A1 * | 3/2005 | Kendrick | 705/4 |
| 2005/0097018 | A1 * | 5/2005 | Takida | 705/35 |
| 2007/0225912 | A1 * | 9/2007 | Grush | 701/213 |
| 2007/0275731 | A1 * | 11/2007 | Alfert et al. | 455/456.1 |
| 2008/0150707 | A1 | 6/2008 | Shamoto | |
| 2008/0316042 | A1 * | 12/2008 | Scales | 340/686.1 |
| 2009/0024458 | A1 * | 1/2009 | Palmer | 705/13 |
| 2009/0192912 | A1 * | 7/2009 | Griffin et al. | 705/26 |
| 2009/0284359 | A1 * | 11/2009 | Huang et al. | 340/426.1 |
| 2010/0070349 | A1 * | 3/2010 | Daems | 705/13 |
| 2010/0145776 | A1 * | 6/2010 | Eguchi et al. | 705/13 |
| 2010/0157061 | A1 * | 6/2010 | Katsman et al. | 348/149 |
| 2010/0161392 | A1 * | 6/2010 | Ashby et al. | 705/13 |
| 2010/0198665 | A1 | 8/2010 | Daems et al. | |
| 2010/0250053 | A1 * | 9/2010 | Grill | G07C 5/085 701/31.4 |
| 2010/0287038 | A1 * | 11/2010 | Copejans | 705/13 |
| 2011/0082797 | A1 * | 4/2011 | Glachant et al. | 705/67 |
| 2011/0131154 | A1 * | 6/2011 | Faber et al. | 705/418 |
| 2011/0131238 | A1 * | 6/2011 | Peeters | G07B 15/063 707/769 |
| 2011/0153267 | A1 | 6/2011 | Peeters et al. | |
| 2011/0275321 | A1 * | 11/2011 | Zhou et al. | 455/41.2 |
| 2011/0282717 | A1 * | 11/2011 | Aschenbrenner et al. | 705/13 |
| 2012/0209776 | A1 * | 8/2012 | Nagy | G06Q 50/30 705/50 |
| 2012/0209976 | A1 * | 8/2012 | McQuade | H04L 41/046 709/223 |

FOREIGN PATENT DOCUMENTS

| | | | | |
|---|---|---|---|---|
| CN | 1584937 | A | 2/2005 | |
| CN | 1695171 | | 11/2005 | |
| CN | 1983929 | | 6/2007 | |
| CN | 101042777 | A | 9/2007 | |
| CN | 101095166 | A | 12/2007 | |
| CN | 101162527 | A | 4/2008 | |
| CN | 101553848 | | 10/2009 | |
| CN | 101568803 | | 10/2009 | |
| DE | 10 2009 045815 | | 4/2010 | |
| EP | 1050853 | A1 | 11/2000 | |
| EP | 1 453 012 | A2 | 9/2004 | |
| EP | 1758066 | * | 2/2007 | G08G 1/123 |
| WO | 2008/135910 | A2 | 11/2008 | |
| WO | WO 2008/142834 | | 11/2008 | |
| WO | 2011/073899 | A1 | 6/2011 | |

OTHER PUBLICATIONS

Extended European Search Report for European Patent Appin. No. 11157818.3 (dated Jul. 6, 2011).

Office Action issued by the State Intellectual Property Office of China for Chinese Application No. 201410479972.3 dated Dec. 23, 2016.

* cited by examiner

ROAD TOLL SYSTEM AND METHOD

CROSS-REFERENCE TO RELATED APPLICATIONS

This application claims the priority under 35 U.S.C. § 119 of European patent application no. 11157818.3, filed on Mar. 11, 2011, the contents of which are incorporated by reference herein.

This invention relates to road toll systems, for implementing an automatic payment system for deducting road tolls based on the road sections used.

The integrated use of telecommunications and informatics is known as telematics. Vehicle telematics systems may be used for a number of purposes, including collecting road tolls, managing road usage, tracking fleet vehicle locations, recovering stolen vehicles, providing automatic collision notification, location-driven driver information services and in-vehicle early warning notification alert systems (car accident prevention).

Road tolling is considered as the first likely large volume market for vehicle telematics. Telematics is now beginning to enter the consumer car environment as a multimedia service box for closed services. These markets are still low in volume and are considered as niche markets. The European union and with The Netherlands as a leading country has the intention to introduce road tolling as an obligatory function for every car.

So far, road tolling has been used for high way billing, truck billing and billing for driving a car in a certain area (e.g. London city). Toll plazas at which vehicles must stop are generally used, or else short range communications systems allow automatic debiting of a fund when a vehicle passes.

The road tolling functions needed in the near future will impose the requirement for less (or no) infrastructure and will impose tolling for every mile driven. The charging system in an automated road toll system can be based not only on the distance travelled, but also the timing, location and vehicle characteristics. The road tolling may apply to all vehicles or it may exclude certain classes of vehicle (for example with foreign number plates).

It is envisaged that the vehicle will have a GPS system on-board and a GSM (mobile telephony network) connection to enable information to be relayed to a centralized road tolling system. These systems are part of an On-board Unit (OBU) that will register the exact usage (where and when) of the car on the road using GPS positioning information. The driver will then pay taxes accordingly.

To ensure that drivers cannot commit fraud, and that everyone only pays what they are due and that privacy can still be respected, a road-pricing system needs to contain a security module, which will necessarily contain a secure hardware component. The security module can digitally sign data such as the time and GPS position the car is located at. This data is then uploaded to a back-end server (e.g. via a wireless GPRS communication) to determine the exact price the driver will have to pay.

To keep the data confidential while in transit, it may also be encrypted by the security module.

Initially, the OBUs will be installed into existing cars (an aftermarket solution). However, some time later, car manufacturers will build this functionality into the car system. This creates a security problem, as the road-pricing units should be protected against fraud and should be tamper resistant. Furthermore, different countries may have different regulations with respect to the required level of security, method of protection, exact functionality, etc.

It may even be possible that the required components for the country of the customer may not be available in the country of car manufacture. Thus, the manufacture and the distribution of new cars may become complicated by new security-related requirements caused by the introduction of the OBU.

Another problem is that the OBU needs to be linked to a tax-paying citizen. This means that the OBU needs to be registered to the owner's name (at least). When the owner wants to sell the car, this creates a complication. Another complication arises when second-hand cars are exported to another country: the destination country may have incompatible regulations, so that export out of the original country may be complicated by export regulations on security products.

Another set of problems is created by rental and lease cars. Although owned by one entity, the cars are driven by customers. Depending on the country's regulations concerning who needs to pay the road-pricing fees, this could be an issue that is hard to address with a built-in OBU.

The security of a road-pricing system could be become compromised by criminals wanting to commit fraud. When the system relies on a built-in security module, it becomes a costly operation if these modules need to be replaced in all cars in a country. Also if a car with a built-in OBU is stolen, the owner is still paying for the kilometers that the thief has driven with the car.

There are thus various problems associated with a fixed OBU, but the alternative of a portable road toll unit is not desirable, since a vehicle can become unusable if the owner forgets to bring the portable unit.

According to the invention, there is provided a road toll arrangement comprising a vehicle mounted unit for use in a road toll system, wherein the vehicle mounted unit comprises a satellite navigation receiver implementing a position tracking function and wherein the road toll system comprises routing means for determining the routes taken by the vehicle based on the position tracking information, pricing means for determining road prices incurred based on the routes taken, and a billing system for billing a user of the system in dependence on the road prices incurred, wherein the road toll arrangement further comprises a portable activation device, wherein the portable activation device is adapted to transmit information concerning the owner of the portable activation device to the vehicle-mounted unit, and the vehicle-mounted unit is adapted to provide information to the billing system to enable identification of the owner of the portable activation device.

The invention provides a portable device, which for example can be in the form of a smart car key, as a security module for providing the user-specific security authorisation to a vehicle-mounted (i.e. built-in) on-board unit of a road pricing system.

Preferably, the portable activation device comprises a transmitter and receiver for communicating with the vehicle-mounted unit and a security module. The security module implements the user-specific aspects of the road toll system. Thus, in combination, the portable activation device and the vehicle-mounted unit can be considered to function in a similar way to a known vehicle-mounted OBU. However, by separating the data necessary to provide user-personalisation into the portable activation device, the vehicle-mounted unit can become more standard, and the user is able to drive other vehicles more easily. For example, the portable activation device can be used with any car in a lease or rental car fleet, while the road-pricing data is tied to the owner of the activation device. Separating the security module from the car also allows for more flexibility in car manufacturing and import and export control issues.

The portable activation device can be a wireless device which is used to remotely unlock the vehicle and/or disable the vehicle immobilisation. In this case, the portable device is implemented as a remote keyless entry car key with an embedded security module, e.g. a smart card module.

The road toll arrangement of the invention (which is the vehicle moounted unit and the activation device) can be used in a road toll system which additionally comprises:

the routing means for determining the routes taken by the vehicle based on the position tracking information;

the pricing means for determining road prices incurred based on the routes taken; and the billing system for billing a user of the system in dependence on the road prices incurred.

The system is preferably adapted to establish a communication channel between the security module and the vehicle-mounted unit via the transmitter and receiver. This provides the channel for the personalisation information to be transferred.

The vehicle-mounted unit preferably comprises means to communicate wirelessly with a remote server (the back-end server) to transmit route information which comprises information about routes taken (for the example of the pricing being calculated in the back-end server) and/or information about pricing relating to the routes taken (for the example of the pricing being calculated in the vehicle-mounted unit), to the remote server.

The vehicle-mounted unit can be adapted to communicate with the portable activation device to send data for signature to the security module derived from the route information, and the security module is adapted to apply a digital signature (and optionally apply an encryption) to the data and return the signed data to the vehicle-mounted unit for communication by the vehicle-mounted unit to the remote server. Thus, the security module in the activation device is used to secure and digitally sign the road-pricing data (which can be route or pricing information as mentioned above) before it is submitted to the billing unit in the back-end server. The security module and the vehicle-mounted unit can for example communicate wirelessly over the existing remote keyless entry communication link between the key and the car.

The portable activation device can be implemented in a variety of ways.

It can comprise:

a wireless smart card which is separate to a vehicle key;

part of a wireless vehicle key, wherein the same channel for immobilisation is used as for transmitting information concerning the owner of the portable wireless activation device to the vehicle-mounted unit;

part of a wireless vehicle key, with a separate card reader provided for the reception by the vehicle-mounted unit of the information concerning the owner of the portable activation device to the channel for immobilisation;

part of a key fob of the vehicle key;

part of a smart card vehicle key, wherein the information concerning the owner of the portable activation device is transmitted to the vehicle-mounted unit by a wired link between the vehicle-mounted unit and smart card vehicle key when inserted in a key slot.

The invention also provides a method of implementing road tolling comprising:

operating a satellite navigation receiver implementing a position tracking function in a vehicle-mounted unit;

determining the routes taken by the vehicle based on the position tracking information;

determining road prices incurred based on the routes taken;

billing a user of the system in dependence on the road prices incurred, wherein the method comprises:

using a portable activation device to transmit information concerning the owner of the portable activation device to the vehicle-mounted unit; and using the vehicle-mounted unit to provide information to the billing system to enable identification of the owner of the portable activation device.

Examples of the invention will now be described with reference to the accompanying drawings, in which.

The invention provides a road toll system using a vehicle-mounted satellite navigation receiver, from which routes taken and road prices incurred are determined. A billing system bills a user in dependence on the road prices incurred. A portable activation device transmits information concerning the owner of the portable activation device to the vehicle-mounted unit, and the vehicle-mounted unit provides information to the billing system to enable identification of the owner of the portable activation device. The invention is directed to the system as a whole, and to the vehicle related components, which are the vehicle-mounted unit and the activation device (which together are termed as a road toll arrangement).

In combination, the portable activation device and the vehicle-mounted unit can be considered to function in a similar way to a known vehicle-mounted OBU. However, by separating the data necessary to provide user-personalisation into the portable activation device, the vehicle-mounted unit can become more standard, and the user is able to drive other vehicles more easily.

The invention relates specifically to the on-board unit and the way it is controlled. FIGS. 1 to 5 show different example of system of the invention, showing only the activation device and the parts of the vehicle-mounted unit that are relevant.

Figure 1:
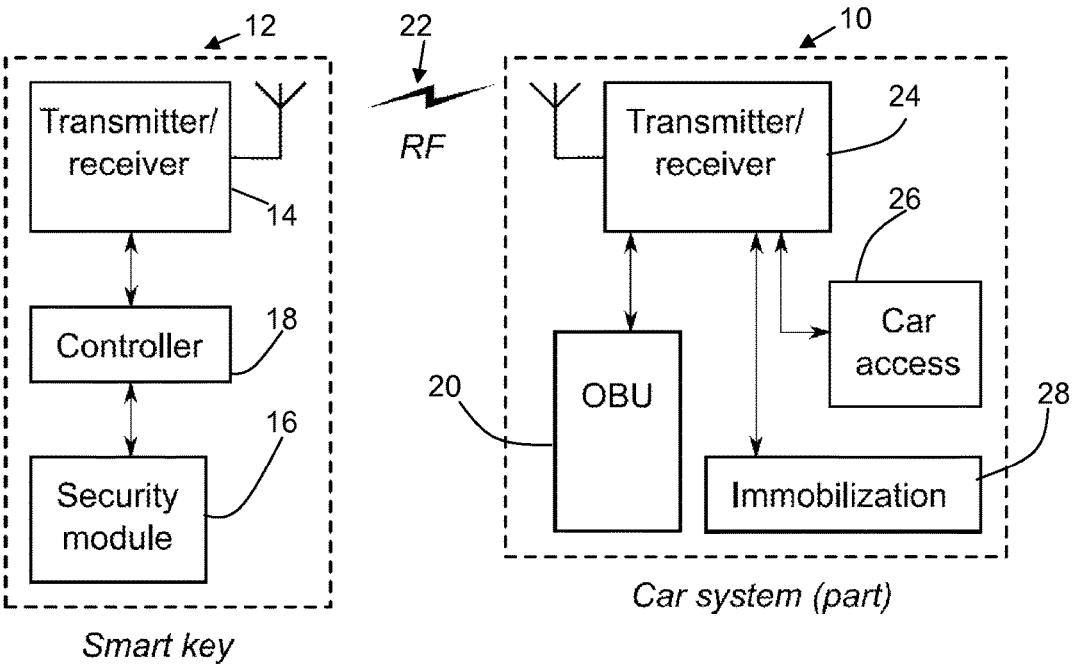
FIG. 1 shows a first example of system of the invention.

FIG. 1 shows a first example, and shows a vehicle-mounted unit 10 and a portable activation device 12. The portable activation device is adapted to transmit information concerning the owner of the portable activation device to the vehicle-mounted unit 10, and the vehicle-mounted unit is adapted to provide information to a billing system to enable identification of the owner of the portable activation device.

The vehicle-mounted unit 10 has a satellite navigation receiver implementing a position tracking function, and a cellular transmitter and receiver for communicating with a back-end server of the system. These are conventional and are not shown in FIGS. 1 to 5.

The system includes routing means for determining the routes taken by the vehicle based on the position tracking information, pricing means for determining road prices incurred based on the routes taken and a billing system for billing a user of the system in dependence on the road prices incurred. These units are distributed between the vehicle-mounted unit and the back-end server as will be explained further below.

The portable activation device 12 comprises a transmitter and receiver 14 and a security module 16. A controller 18 controls the transmitter and receiver, and the security module 16. The security module implements the user personalisation of the system and is used to personalize a built-in on-board unit 20 (OBU) of the vehicle-mounted unit 10 for a road-pricing system.

The data stored in the security module can comprise:

Public and private key pair for digital signatures;

Public key certificate for digital signature;

Public and private key pair for authentication (to set up a secure channel);

Public key certificate for authentication;

A user identification or subscription or account number, by which the back-end system can recognize the user.

The activation unit 12 is part of a remote keyless entry (RKE) car key and can be a smart card module. The security module in the smart car key is used to secure and digitally sign the road-pricing data before it is submitted to the road-pricing back-end server. Whenever the OBU wants to upload road-pricing data to the back-end server, it submits an extract of this data to the security module in the activation device 12. The security module generates a digital signature for this data and, optionally, encrypts it for the server. The signed and encrypted data is sent back to the OBU, which uploads it to the server. The digital signature and encryption systems are entirely conventional.

In the example of FIG. 1, the security module 16 and the OBU 20 communicate wirelessly over the existing remote keyless entry communication link 22 between the key and the car. For this purpose, the vehicle-mounted unit includes a transmitter and receiver 24, a car access unit 26 (for controlling the door locks) and an immobilisation unit 28.

Thus, the portable activation device 12 is in this example a wireless device which is used to remotely unlock the vehicle and to disable the immobilization of the vehicle. The unlocking and the immobilization can use different frequencies, so the transmitter/receiver may be in fact two different transmitter/receivers.

In this first example, the activation device can remain in the driver's pocket. It communicates over the wireless link to the car, using the same channel as the car access unit. The data relating to road pricing is forwarded between the security module in the smart key and the OBU.

Figure 2:
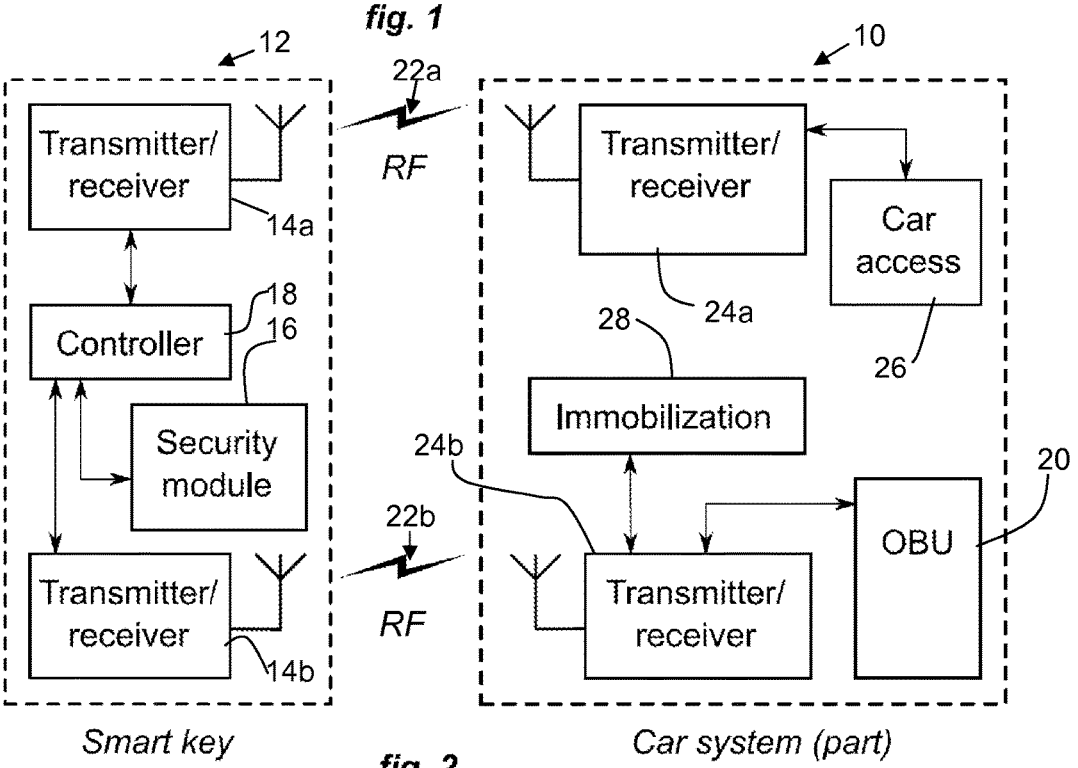
FIG. 2 shows a second example of system of the invention.

In a second example, the activation device can be inserted in the ignition slot. It communicates over the wireless link to the car, using the same channel as the immobilization unit. FIG. 2 shows one example of this, with a first wireless link 22*a* for the car access (door unlocking) with associated transmitter and receiver 14*a* in the activation device and 24*a* in the vehicle-mounted unit, and a second (for example shorter range) wireless link 22*b* for the immobilisation function and for the transfer of personalisation information to the OBU. The associated transmitter and receiver in the activation device are shown as 14*b* and in the vehicle-mounted unit as 24*b*.

Figure 3:
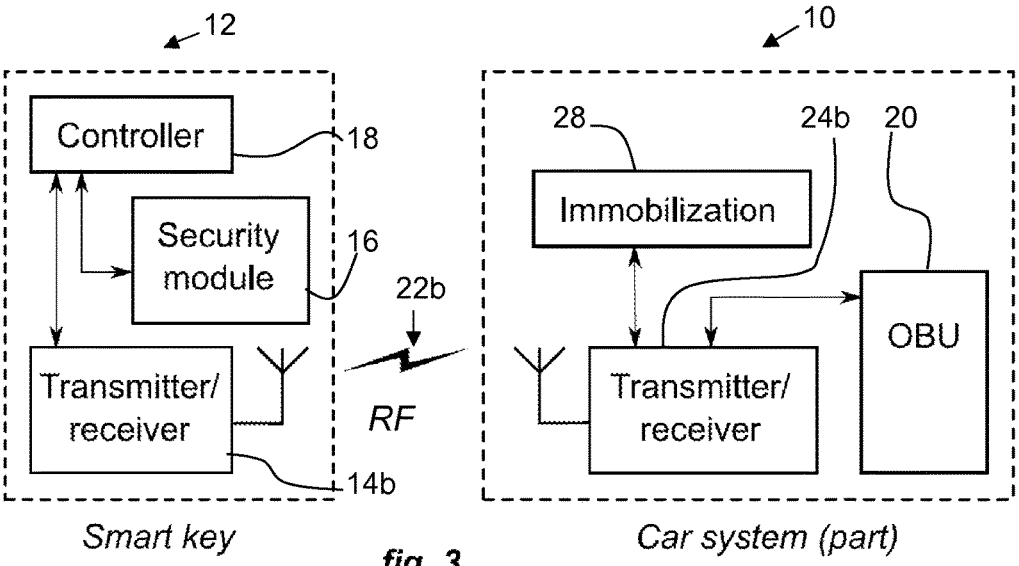
FIG. 3 shows a third example of system of the invention.

FIG. 3 shows a further example with only the shorter range wireless link 22*b*. This can be a separate device to the key.

Figure 4:
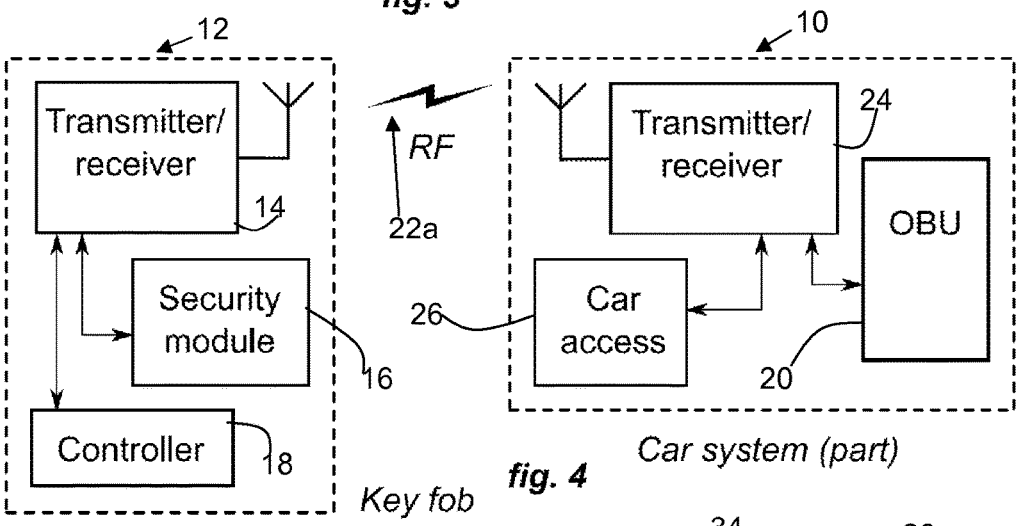
FIG. 4 shows a fourth example of system of the invention.

FIG. 4 shows an example where the security module can be inside a key fob. It communicates over the wireless link to the car, using the same channel 22*a* as the car access unit. In this case, the car immobilisation is by a separate device, such as a physical key or card-type key.

Figure 5:
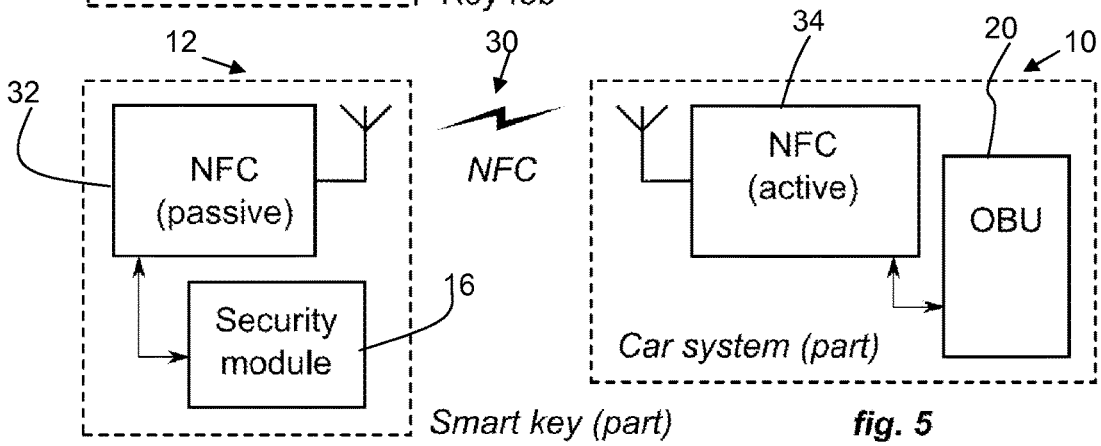
FIG. 5 shows a fifth example of system of the invention.

FIG. 5 shows an example in which a smart key is inserted in the ignition slot, where a near field communication reader (such as RFID) is present that is linked to the OBU. The reader establishes communication with the key. The key and the OBU exchange data over the near field communication (NFC) channel 30. In this example, the activation device is passive and is energised when in range of the active device of the vehicle-mounted unit. The activation device has a passive near field communication system 32 coupled to the security module and the vehicle-mounted unit has an active near field communication system 34 coupled to the OBU 20. The car access and immobilisation functions can be implemented in the various different ways as shown in FIGS. 1 to 4.

In another example, a smart key can again be inserted in the ignition slot, but the slot contains terminals linked to card reader functionality. In this case, a wired link can be established between the OBU and security module in the smart key, instead of the near field communication link of FIG. 5.

Thus, various ways of combining the required communication link between the activation device and the OBU with the existing communications links to the vehicle are possible. The link for car access can be reused, or the link for car immobilisation, or the link from an electronic key inserted into a key slot, or else a separate dedicated link can be provided.

Figure 6:
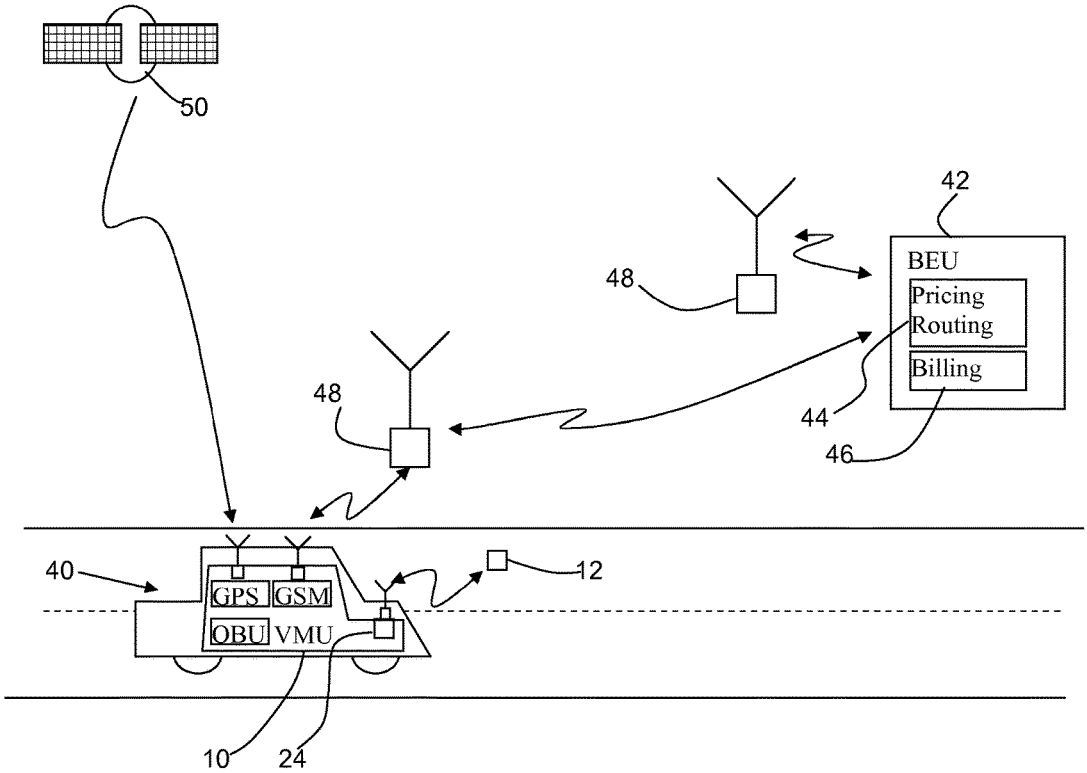
FIG. 6 shows the system more completely, including the back-end server.

FIG. 6 shows a vehicle 40 equipped with a system of the invention. As shown, the vehicle-mounted unit ("VMU") 10 has a GSM transmitter ("GSM") to communicate wirelessly with a remote server in a back end unit ("BEU") 42, to transmit route information to the remote server. In the example shown, the back end unit 42 includes the routing and pricing module 44 and billing module 46. The communication to the back end unit is via cellular base stations 48.

The vehicle-mounted unit 10 also has a GPS receiver "GPS" for receiving satellite signals from GPS satellites 50.

FIG. 6 also shows the OBU as well as the short range receiver/transmitter 24 as part of the vehicle-mounted unit 10, and the remote activation device 12.

In the system of the invention, the road-pricing functionality built-in to the vehicle is separated from the security module used to identify the driver. This simplifies car manufacture and allows for more flexibility. The activation device (key) manufacture, which incorporates the user-specific functions, can for example take place in another part of the world. Export control on the security modules can be settled entirely separate from the car export/import itself. The keys can for example be produced in the country of destination.

Different countries and legislations can use their own system and the system can be changed relatively easy.

The separation of the security functions into a portable activation device means the security module is registered to a driver/citizen, instead of the car. When trading in a car, the activation device can stay with the driver.

For fleet management, any activation device can be used with any car from the fleet, and the distance travelled and other services used are tied to individual user.

For rental car scenarios, each customer has his own activation device (like a loyalty card). The activation device can be used with any rental car and will be used automatically to register road usage. The owner of the activation device will be billed for the road usage automatically.

The system provides a relatively easy upgrade or replacement of the road-pricing system security if it becomes threatened or compromised.

When the car is stolen without stealing the activation device, the owner of the car will not be registered as driving with the car, as the key with the security module is not present.

In some examples, communication between the security module of the activation device and the built-in part of the OBU can re-use existing communication channels, so no additional hardware is required.

Additional services can relatively easily be added to the OBU system by means of the activation device.

Various options for the activation device have been mentioned above. There are also various options for the other aspects of the system, for example in-advance billing or post billing, and different ways to implement the required data transfer to the back-end unit. However, these other aspects are not altered by the invention, and all known options are possible. By way of example, in the most common configuration, the OBU will transmit batches of position information to the back-end server, where the route calculation, pricing and billing is carried out. The position data is sent together with timing information. This can be ideally done by a GSM function (General Packet Radio Service "GPRS" or Third Generation mobile telephony) using a cellular modem.

Instead of sending position information, the route calculation can be carried out in the OBU. Similarly, the pricing module can also be in the OBU, so that pricing information is instead sent to the back-end server. Some verification can be implemented in the back-end server that the pricing information has not been tampered, for example by having some position information sent as well but with a lower frequency. This will of course require a channel for pricing changes to be notified to the OBU. The different approaches provide different compromises between the amount of data that has to be sent and the security, privacy and tamper resistance of the system.

The system can enable the user to obtain the actual price information of the road he is driving. This could be obtained by using a real time on-line enquiry system and data transmission. For example, pushing a price request button will send the latest GPS coordinate to the server, and the server responds with road price, which is then displayed to the user. This provides a low cost service.

The invention is relevant generally to road toll systems, but it is also relevant to pay-as-you-go insurance systems, where again the cost is dependent on the route taken. Thus, the term "road prices" can include as an option an insurance price associated with a road.

The system can use any communications network for communication between the vehicle-mounted unit and the back-end unit. This can be periodic by batch transfer so that full coverage is not required.

Various additional features and modifications will be apparent to those skilled in the art.

The invention claimed is:

1. A road toll system comprising:

a vehicle-mounted unit for use in the road toll system, wherein the vehicle-mounted unit comprises a satellite navigation receiver implementing a position tracking function used by a routing system for determining routes taken by a vehicle based on position tracking information; and a portable activation device that is not mounted on the vehicle, the portable activation device comprising:

a transmitter and receiver; and a security module, wherein the security module is configured to implement user-personalization data to personalize the vehicle-mounted unit, wherein the user-personalization data is stored in the portable activation device separate from the vehicle-mounted unit, and wherein the security module applies a digital signature to route information received from the vehicle-mounted unit, wherein the road toll system is adapted to establish a wireless communication channel between the security module and the vehicle-mounted unit via the transmitter and receiver;

wherein the portable activation device is adapted to transmit information concerning an owner of the portable activation device and the digitally signed route information to the vehicle-mounted unit via the wireless communication channel, and wherein the vehicle-mounted unit is adapted to provide information to a billing system to enable identification of the owner of the portable activation device for billing a user of the system in dependence on the road prices incurred based on the routes taken.

2. The road toll system of claim 1, wherein the portable activation device is a wireless device which is used to remotely unlock the vehicle.

3. The road toll system of claim 1, wherein the portable activation device is a wireless device used to disable an immobilization unit of the vehicle.

4. The road toll system of claim 1, wherein the vehicle-mounted unit comprises an element that can communicate wirelessly with a remote server to transmit route information which comprises information about routes taken and/or information about pricing relating to the routes taken, to the remote server.

5. The road toll system of claim 4, wherein the vehicle-mounted unit is adapted to communicate with the portable activation device to send data for signature to the security module derived from the route information, and the security module is adapted to apply a digital signature to the data and return the signed data to the vehicle-mounted unit for communication by the vehicle-mounted unit to the remote server.

6. The road toll system of claim 5, wherein the security module is further adapted to encrypt the data for signature.

7. The road toll system of claim 1, wherein the portable activation device comprises one of:

a wireless smart card which is separate to a vehicle key;

part of a wireless vehicle key, wherein the same channel for immobilization is used as for transmitting information concerning the owner of the portable wireless activation device to the vehicle-mounted unit;

part of a wireless vehicle key, with a separate card reader provided for the reception by the vehicle-mounted unit of the information concerning the owner of the portable activation device to the channel for immobilization;

part of a key fob of the vehicle key; and part of a smart card vehicle key, wherein the information concerning the owner of the portable activation device is transmitted to the vehicle-mounted unit by a wired link between the vehicle-mounted unit and smart card vehicle key when inserted in a key slot.

8. A method of implementing road tolling in a road tolling system comprising a vehicle-mounted unit, the vehicle-mounted unit comprising a satellite navigation receiver and a transmitter and receiver to wirelessly communicate with a portable activation device, the portable activation device comprising a transmitter and receiver and a security module, the method comprising:

operating the satellite navigation receiver to implement a position tracking function in the vehicle-mounted unit used by a routing system for determining route information including routes taken by a vehicle based on the position tracking information;

using the vehicle-mounted unit transmitter to establish a wireless communication channel to send data derived from the route information to the portable activation device that is not mounted on a vehicle for the portable activation device to apply a digital signature to the route information using a security module, wherein the security module is configured to implement user-personalization data to personalize the vehicle-mounted unit, wherein the user-personalization data is stored in the portable activation device separate from the vehicle-mounted unit;

using the vehicle-mounted unit to transmit information concerning an owner of the portable activation device and the digitally signed data from the portable activation device to a billing system to enable identification of the owner of the portable activation device for billing a user of the system in dependence on the road prices incurred based on the routes taken.

9. The method of claim 8, further comprising using the portable activation device to remotely unlock the vehicle and/or to disable an immobilization unit of the vehicle.

10. The method of claim 8, further comprising establishing a communication channel between the security module of the portable activation device and the vehicle-mounted unit and comprising the vehicle-mounted unit communicating wirelessly with a remote server to transmit said digitally signed route information which comprises information about routes taken and/or information about pricing relating to the routes taken, to the remote server.

11. The method of claim 10, further comprising:

the vehicle-mounted unit communicating with the portable activation device to send data for signature to the security module derived from the route information;

the security module applying a digital signature to the data and returning the signed data to the vehicle-mounted unit; and the vehicle-mounted unit communicating the digitally signal data to the remote server.

12. The method of claim 11, wherein the security module encrypts the data for signature.

13. A vehicle-mounted unit comprising:

a satellite navigation receiver configured to implement a position tracking function;

a transmitter-receiver unit configured for short-range wireless communication established over a wireless communication channel with a security module external to the vehicle-mounted unit and not mounted on a vehicle;

wherein the security module is configured to implement user-personalization data to personalize the vehicle-mounted unit, wherein the user-personalization data is stored in a portable activation device separate from the vehicle-mounted unit; and an on-board unit configured to send data, which is derived from route information based on the position tracking function to the security module via the transmitter-receiver unit to be digitally signed by the security module and, once digitally signed, to send the signed data to a remote server.

14. The vehicle-mounted unit of claim 13, wherein the transmitter-receiver unit is an active near field communication system coupled to the on-board unit.

15. The vehicle-mounted unit of claim 14, wherein the external security module is the portable activation device.

16. The vehicle-mounted unit of claim 15, wherein the portable activation device comprises a passive near-field communication system.

* * * * *